US006668980B2

(12) United States Patent
Smith

(10) Patent No.: US 6,668,980 B2
(45) Date of Patent: Dec. 30, 2003

(54) ELEVATOR CAR ISOLATION SYSTEM AND METHOD

(75) Inventor: Rory Smith, Germantown, TN (US)

(73) Assignee: Thyssen Elevator Capital Corp., Whittier, CA (US)

( * ) Notice: Subject to any disclaimer, the term of this patent is extended or adjusted under 35 U.S.C. 154(b) by 9 days.

(21) Appl. No.: 09/900,651

(22) Filed: Jul. 6, 2001

(65) Prior Publication Data

US 2003/0010577 A1 Jan. 16, 2003

(51) Int. Cl.[7] ..... B66B 11/02
(52) U.S. Cl. ..... 187/401; 187/292
(58) Field of Search ..... 187/266, 401, 187/292, 343, 345; 57/236, 237, 243, 244, 245, 248; 52/30

(56) References Cited

U.S. PATENT DOCUMENTS

| | | | | | |
|---|---|---|---|---|---|
| 1,907,967 | A | * | 5/1933 | Himes | 187/401 |
| 2,246,732 | A | * | 6/1941 | Hymans | 187/401 |
| 3,708,991 | A | * | 1/1973 | Barkley | 405/194 |
| 4,412,601 | A | * | 11/1983 | Cooper | 187/261 |
| 4,548,297 | A | | 10/1985 | Salmon et al. | 187/411 |
| 4,599,832 | A | * | 7/1986 | Benton et al. | 52/118 |
| 4,657,116 | A | * | 4/1987 | Gardner et al. | 187/401 |
| 4,766,708 | A | | 8/1988 | Sing | 52/167.8 |
| 5,005,671 | A | | 4/1991 | Aime et al. | 187/345 |
| 5,020,639 | A | | 6/1991 | Michel | 187/346 |
| 5,025,893 | A | | 6/1991 | Saito | 187/266 |
| 5,074,382 | A | * | 12/1991 | Do | 187/239 |
| 5,181,586 | A | | 1/1993 | Yoo et al. | 187/411 |

(List continued on next page.)

FOREIGN PATENT DOCUMENTS

| | | | | |
|---|---|---|---|---|
| EP | 0675066 | | 4/1998 | |
| JP | 352055145 | * | 5/1977 | 187/401 |
| JP | 352101547 | * | 8/1977 | |
| JP | 354040451 | * | 3/1979 | 187/401 |
| JP | 404085275 | * | 3/1992 | 187/401 |
| JP | 405246658 | * | 9/1993 | 187/401 |
| WO | 9929610 | | 6/1999 | |

OTHER PUBLICATIONS

Elevator World, V45, n6, Jun. 1997, p. 88–93.

Proceedings of the IEEE Conference on Control Applications, v2, 1994, IEEE, Piscataway, NJ, 94CH3420–7, p. 965–970.

Vibration Damping Workshop Proceedings, Long Beach, California, Feb. 27–29, 1984, AD–A152 547 pLL–1–LL–6, published Nov. 84.

*Primary Examiner*—Eileen D. Lillis
*Assistant Examiner*—Paul T. Chin
(74) *Attorney, Agent, or Firm*—White & Case LLP

(57) ABSTRACT

The isolation system and method comprise suspending an elevator platform from an upper portion of an elevator sling with upper tension members. In addition to being suspended from the sling by upper tension members, the elevator car platform may be secured to a lower portion of the sling from with lower tension members. The tension members preferably have an in-use frequency of vibration below the frequencies of the elevator system vibrations. In an alternative embodiment, upper vibration attenuating tension members may be used to suspend the elevator car platform and the platform may be secured to the lower portion of the sling with standard isolation mounts instead of lower tension members. The tension members employed by the present invention may be manufactured from cables containing aramid fibers, such as Kevlar® rope.

11 Claims, 2 Drawing Sheets

U.S. PATENT DOCUMENTS 5,230,404 A * 7/1993 Klein ..... 187/414
5,325,937 A 7/1994 Suchodolski et al. ..... 187/401
5,490,577 A 2/1996 Yoo ..... 187/252
5,566,786 A * 10/1996 De Angelis et al. ..... 187/266
5,584,364 A 12/1996 Sakita ..... 187/249
5,597,988 A 1/1997 Skalski ..... 187/393
5,611,412 A 3/1997 Yoo et al. ..... 187/412
5,811,743 A 9/1998 Kohara et al. ..... 187/393
5,832,688 A * 11/1998 Crissey et al. ..... 52/651.01
5,845,745 A 12/1998 Lane ..... 187/259
5,881,843 A 3/1999 O'Donnell et al. ..... 187/254
5,881,845 A * 3/1999 O'Donnell et al. ..... 187/411
6,164,418 A * 12/2000 Chen et al. ..... 187/401
6,364,063 B1 * 4/2002 Aulanko et al. ..... 187/266

* cited by examiner

ELEVATOR CAR ISOLATION SYSTEM AND METHOD

BACKGROUND OF THE INVENTION

1. Field of the Invention

The present invention relates to elevator systems. In particular, the present invention provides a method and apparatus for isolating elevator cars and platforms from vibrations.

2. Description of the Related Art

Vibrations are typically induced in elevator systems by a variety of sources. As elevator cars traverse elevator shafts, vibrations are induced by curves in the guide rails and by level differences in the guide rails. Moreover, an elevator hoist rope can transmit elevator lift motor vibrations to an elevator car. In addition, aerodynamic forces, braking forces and other mechanical sources induce a range of vibrations in an elevator system and these vibrations are often transmitted to an elevator car operating in the elevator system. In a modern elevator system, an elevator car sits on a platform that is mounted to an elevator sling. The platform is suspended from the sling by steel cables or brace rods. These cables or brace rods transmit the vibrations from the elevator system to the elevator platform and elevator car. The average power transmitted by these rods and/or cables is a function of their density, which, in the case of steel, is relatively high.

To prevent transmission of vibrational energy from the elevator system to the elevator car, most elevator manufacturers employ isolation devices, such as isolation pads, primarily manufactured from rubber, between the cables or brace rods and the elevator platform. In some applications, the platform may rest on a rubber pad that in turn rests on the elevator sling. While rubber isolation pads are relatively inexpensive and provide some attenuation to vibrations that occur in elevator systems, they have a relatively high natural frequency. Under standard loading conditions, rubber isolation pads and rod braces have a natural frequency of about 20 Hz. Attenuating media can only attenuate vibrations whose frequencies are greater than about 1.141 times the natural frequency of the attenuating media. Thus, rubber isolation devices can only attenuate vibrations over a relatively limited range of frequencies.

SUMMARY OF THE INVENTION

The present invention provides a vibration attenuated elevator car assembly and method for isolating an elevator car from vibrations having a range of frequencies that are typically encountered in elevator systems. According to one embodiment of the present invention, a vibration attenuated elevator car assembly for attenuating elevator system vibrations is used to secure an elevator car platform to an elevator sling that travels on elevator rails in an elevator shaft. The vibration attenuated elevator car assembly comprises an elevator car platform that is horizontally suspended from the elevator sling by upper tension members and that is also secured to a lower portion of the elevator sling by lower tension members. Thus, the elevator car platform is not indirect contact with the elevator sling.

Preferably, the elevator car is isolated from elevator system vibrations by suspending the elevator car platform from an upper portion of the elevator sling with tension members manufactured from synthetic fiber because synthetic fibers transmit significantly less energy at any tension, frequency, and amplitude than steel due to their lower density. Material containing aramid fibers, such as Kevlar® rope or Kevlar® cored rope with a Nomex® sheath, is particularly well-suited for use as a tension member because it has relatively low in-use natural frequencies. Vectran® and generic Aramid are also well-suited for use with the present invention.

As an alternative to using lower tension members, the elevator car platform may be secured to a safety plank or other lower structural member of the elevator sling with isolation mounts. In this embodiment, the car platform would still be suspended from the sling with upper tension members having an in-use natural frequency below that of the vibrations typically found in the elevator system.

DETAILED DESCRIPTION OF THE INVENTION

Figure 1:
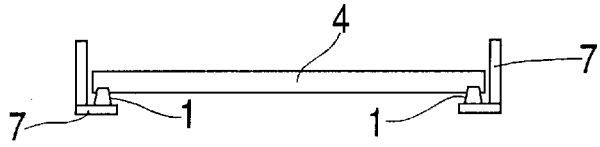
FIG. 1 PRIOR ART
FIG. 1 illustrates a prior art elevator car isolation system.

FIG. 1 illustrates the prior art elevator car isolation systems. Elevator platforms and cars are isolated from vibration by use of rubber isolation pads 1. These rubber elements separate the isolated platform 4 from a structural platform 7 that is rigidly fixed to the elevator car frame. As is described in further detail below, the present invention may be used in conjunction with the prior art isolation systems or may be used alone.

Figure 2:
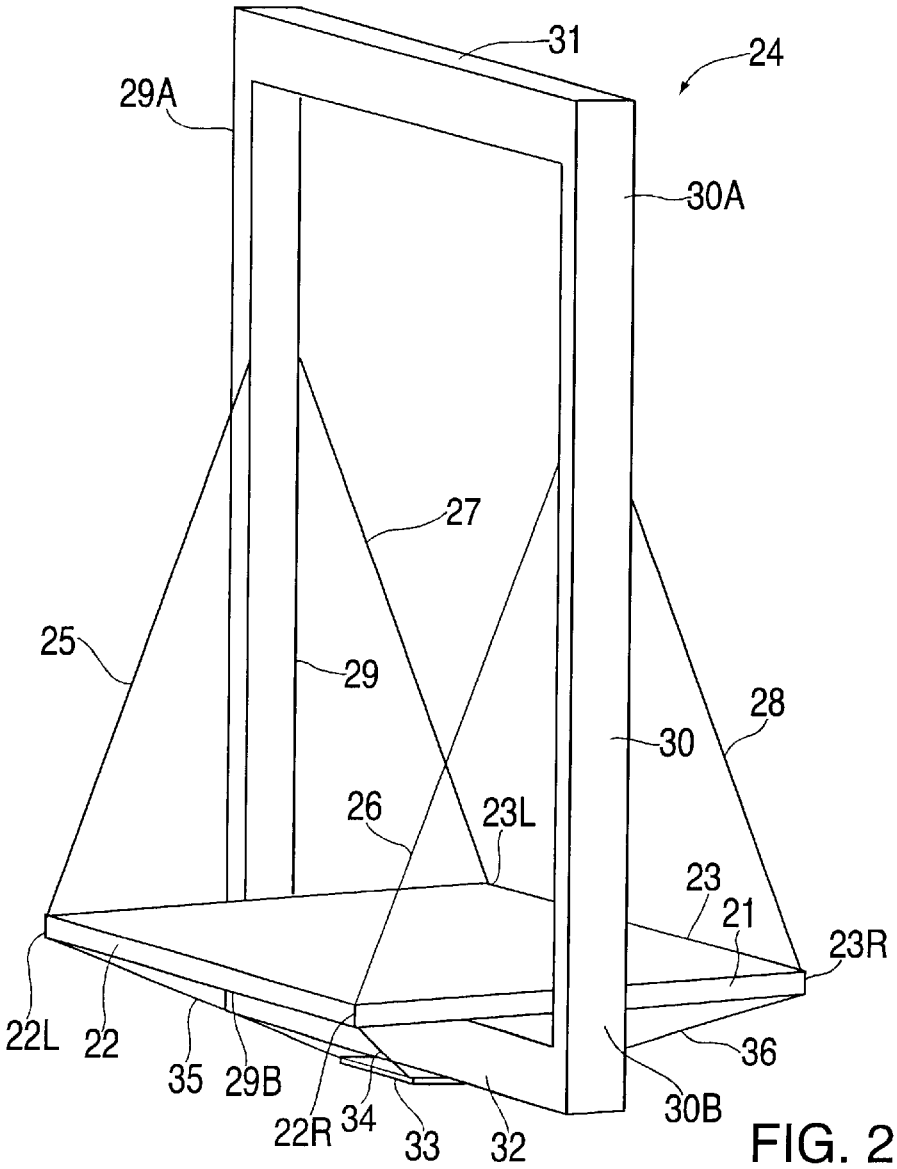
FIG. 2 illustrates a vibration attenuated car assembly according to the present invention, wherein the elevator car platform is fastened to an elevator sling with upper and lower tension members of the present invention.

As is shown in FIG. 2, a elevator car platform 21 for supporting an elevator car (not shown), having a front edge 22 with a left front corner 22L and a right front corner 22R and back edge 23 with a left back corner 23L and a right back corner 23R, is suspended from an upper portion of elevator sling 24 by a plurality of upper tension members 25, 26, 27, and 28. The upper portion of the sling 24 is that portion above the elevator car platform 21. Conversely, any portion of the sling 24 below the elevator car platform 21 may be referred to as the lower portion the sling 24. The sling 24 has a left stile 29 and right stile 30. The left stile 29 and right stile 30 have upper portions 29A and 30A, respectively, and lower portions 29B and 30B, respectively. A crosshead 31 spans and connects the upper portions of the stiles 29A and 30A. And a safety plank 32 spans the lower portions of the stiles 29B and 30B. A fastening plate 33 is mounted in a center portion of and under the safety plank 32. Those skilled in the art will recognize that the crosshead 31 need not be affixed at the exact upper ends of the stiles 29 and 30 and likewise the safety plank 32 need not be affixed at the exact bottom of the stiles 29 and 30.

Upper tension member 25 secures the left front corner of the platform 22L to the upper portion 29A of the left stile 29 and is fastened to the platform 21 and stile 29 with standard fasteners. Upper tension member 26 secures the right front corner of the platform 22R to the upper portion 30A of the right stile 30 and is fastened to the platform 21 and stile 30 with standard fasteners. Upper tension member 27 secures the left back corner of the platform 23L to the upper portion 29A of the left stile 29 and is fastened to the platform 21 and the stile 29 with standard fasteners. Upper tension member 28 secures the right back corner of the platform 23R to the upper portion 30A of the right stile 30 and is fastened to the platform 21 and the stile 30 with standard fasteners.

In addition to being suspended from the upper portions 29A and 30A of the stiles 29 and 30 of the elevator sling 24, the elevator car platform 21 may also be secured to the safety plank 32 by a plurality of lower tension members. Lower tension member 34 secures the right front corner of the platform 22R to a fastening plate 33 and may be fastened to the fastening plate 33 and the platform 21 with standard fasteners. Lower tension member 35 secures the left front corner of the platform 22L to the fastening plate 33 and may be fastened to the fastening plate 33 and the platform 21 with standard fasteners. Lower tension member 36 secures the right back corner of the platform 23R to the fastening plate and may be fastened to the fastening plate 33 and the platform 21 with standard fasteners. A fourth lower tension member (not shown) secures the left back corner of the platform 23L to the fastening plate 33 and may be fastened to the fastening plate 33 and the platform 21 with standard fasteners. The upper and lower tension members may, but need not, be fastened to the exact corners of the elevator car platform 21. The upper and lower tension members may be fastened to the platform 21 in any manner that provides adequate support for the platform 21.

The upper and lower tension members are preferably made of a material having a low ability to transmit power and have a low in-use natural frequency, preferably below the frequency of vibrations found in an elevator system, which is typically between 4 and 8 Hz. In general, the average power that can be transmitted is defined by the following equation:

$$\overline{P} = \frac{1}{2}\mu\upsilon\omega^2 y_m^2$$

Where density $$\mu = \frac{m}{l} \quad m = \text{mass} \quad l = \text{length.}$$

Where Wave velocity $$\upsilon = \sqrt{\frac{\text{tension}}{\mu}}$$

Where frequency and amplitude are represented by Ω& y.

Cable or rope containing aramid fibers, such as Kevlar® rope or Kevlar® cored rope having a fire resistant sheath made from a material, such a Nomex® or a fire resistant coating, is particularly well-suited for use as a tension member because it has a low density. Spectra, graphite and fiberglass ropes or other composites structures may also be used as tension members. The ropes or cables that form tension members may comprise woven, bundled, or twisted fibers, and may in some, but not all embodiments, be covered with a sheath. Tension members should be sufficiently strong and stiff to support a fully loaded elevator car. Preferably, but not necessarily, the tension members should have a working load of 3000 pounds or greater. Often this requires the use of an aramid fiber rope having a 0.5 inch or greater diameter. The tension members should have a strength and a working load rating substantially equivalent to ⅝ inch diameter steel rods, which are typically used to suspend elevator car platforms. Typically, the upper tension members of the present invention are about 2 meters long. In some embodiments, it may be desirable to have tension members having a density of less than about 7.7 grams per cubic centimeter ("g/cc") and preferably less than 2.5 g/cc. In one embodiment, where 0.5 inch diameter Kevlar® 49 sheathed rope is used, the tension members preferably have a linear mass density of about 0.138 kilograms per meter of length. In some situations, it may be advantageous to use different material for the upper and lower tension members. Likewise, the strength and other physical properties of the upper and lower tension members do not necessarily have to be identical and in certain situations better attenuation might be achieved by using upper tension members that have different properties than the lower tension members.

While the embodiment of the present invention described in the above example employs four upper tension members and four lower tension members, those of skill in the art will appreciate that the number and placement of the tension members may be varied depending upon other design criteria. Moreover, while it is often preferable to use materials for the tension members that cause the tension members to have low natural frequencies—to attenuate a large range of frequencies—it may, depending upon the frequency of vibrations that are to be attenuated, be desirable to use tension members having high, medium, low or ultra low natural frequencies. Likewise, the density of the tension member may vary.

Figure 3:
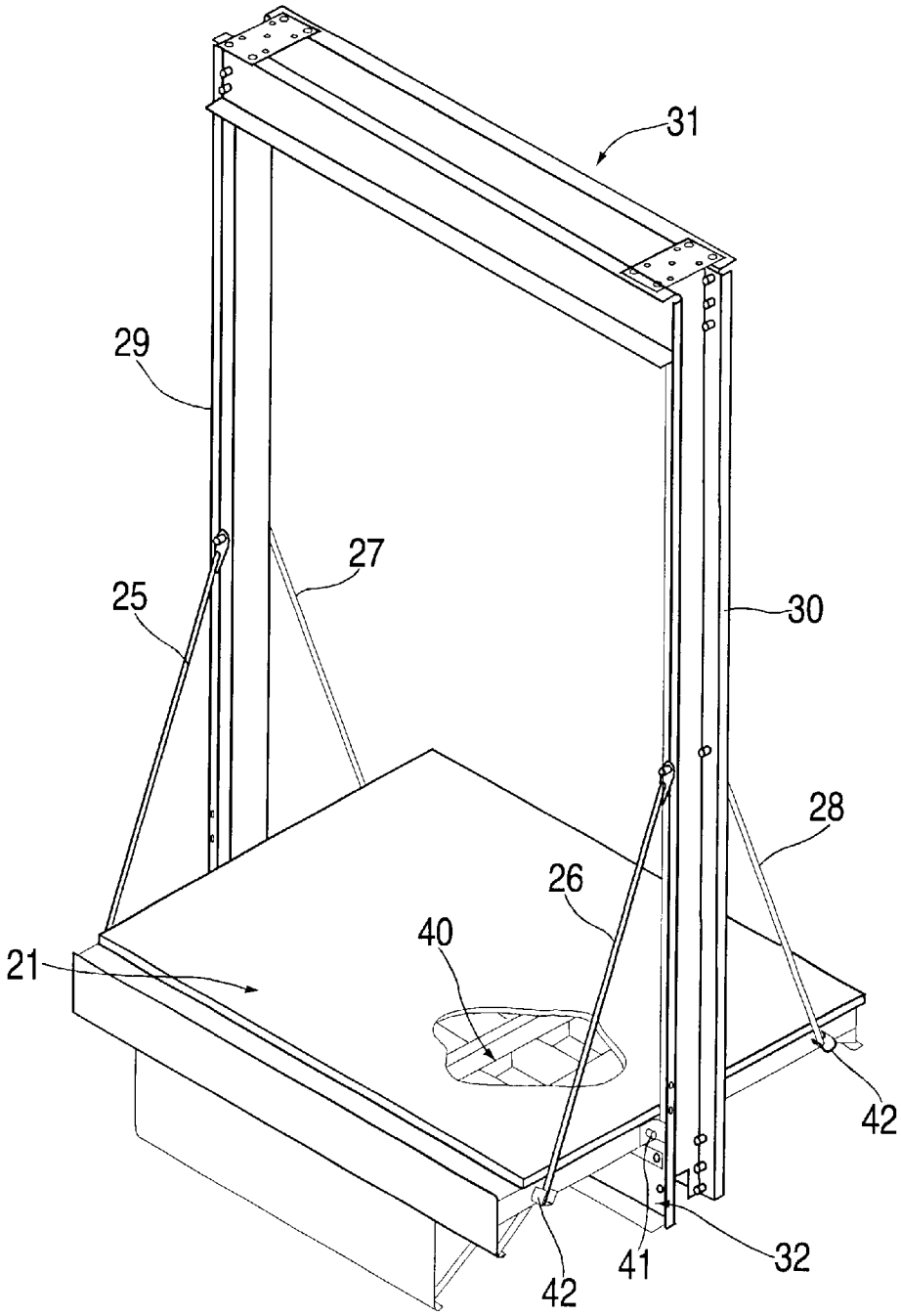
FIG. 3 illustrates a vibration attenuated car assembly according to the present invention, wherein the elevator car platform is fastened to an elevator sling with upper tension members of the present invention and is fixed to a lower portion of the sling with isolation mounts.

As is shown in FIG. 3, an alternative embodiment of the present invention employs four upper tension members 25, 26, 27, and 28 to suspend the platform 21 from the right and left stiles 29 and 30 of the elevator sling. Upper tension members 25, 26, 27, and 28 are made from aramid fiber rope, such as Kevlar® cored rope and may be secured to the platform with standard means, such as isolation anchors 42. The upper tension members 25, 26, 27, and 28 should have a low in-use natural frequency, preferably a frequency below that of vibrations found in an elevator system. The platform 21 rests on platform isolation pads 40 that are mounted to the top of the safety plank 32. In addition, the platform is secured to the stiles 29 and 30 with stile isolation pad and retainer brackets 41.

The isolation pads and isolation anchors that may be used with the present invention may be standard rubber isolation pads, or they may be pads manufactured from other materials, including aramid fibers, that are inefficient at transmitting energy.

The present invention may be used in standard elevator systems, including roped and hydraulic systems, and in elevator systems that employ synthetic fiber hoist ropes, which also help dampen vibrations transmitted from the elevator system to elevator cars in the system.

What is claimed is:

1. An elevator car assembly for attenuating elevator system vibrations in an elevator system, the elevator car assembly comprising:

an elevator car sling for traveling in an elevator shaft and for supporting an elevator car platform, the elevator car sling having an upper portion and a lower portion;

one or more upper tension members for suspending an elevator car platform from the upper portion of the elevator car sling, the upper tension members comprising synthetic fibers;

one or more lower tension members comprised of synthetic fibers for securing an elevator car platform to the lower portion of the elevator sling; and said elevator car platform suspended horizontally from the upper portion of the elevator sling by the upper tension member(s) and secured to the lower portion of the elevator sling by the lower tension member(s).

2. The elevator car assembly of claim 1, wherein the upper tension member(s) contain aramid fibers.

3. The elevator car assembly of claim 1, wherein the upper tension member(s) contain a fire resistant coating.

4. The elevator car assembly of claim 1, 2, or 3, wherein the upper tension member(s) have a vibrational frequency below the frequencies of the elevator system vibrations.

5. The elevator car assembly of claim 1, 2, or 3, wherein the upper tension member(s) have a density of about 0.138 kg/m.

6. The elevator car assembly of claim 1, wherein the lower tension member(s) contain aramid fibers.

7. The elevator car assembly of claim 1, wherein the lower tension member(s) contain a fire resistant sheath.

8. The elevator car assembly of claim 1, 6, or 7, wherein the lower tension member(s) have a vibrational frequency below the frequencies of the elevator system vibrations.

9. The elevator car assembly of claim 1, 6, or 7, wherein the lower tension members have an in-use frequency below 8 Hz.

10. The elevator car assembly of claim 1, wherein the upper and lower tension member(s) contain aramid fibers.

11. The elevator car assembly of claim 1, wherein the upper and lower tension members contain a fire resistant sheath.

* * * * *